US012134845B2

(12) United States Patent
Wagner et al.

(10) Patent No.: US 12,134,845 B2
(45) Date of Patent: Nov. 5, 2024

(54) SPUNBOND NONWOVEN OF CONTINUOUS FILAMENTS AND OF MAKING SAME

(71) Applicant: REIFENHÄUSER GMBH & CO. KG MASCHINENFABRIK, Troisdorf (DE)

(72) Inventors: Tobias Wagner, Cologne (DE); Sebastian Sommer, Troisdorf (DE); Patrick Bohl, Hennef (DE); Andreas Roesner, Bonn (DE); Hans-Georg Geus, Niderekassel (DE); Gerold Linke, Hennef (DE)

(73) Assignee: REIFENHAEUSER GMBH & CO. KG MASCHINENFABRIK, Troisdorf (DE)

( * ) Notice: Subject to any disclaimer, the term of this patent is extended or adjusted under 35 U.S.C. 154(b) by 207 days.

(21) Appl. No.: 17/426,834

(22) PCT Filed: Jul. 14, 2020

(86) PCT No.: PCT/EP2020/069906
§ 371 (c)(1),
(2) Date: Aug. 8, 2021

(87) PCT Pub. No.: WO2021/018574
PCT Pub. Date: Feb. 4, 2021

(65) Prior Publication Data

US 2022/0251747 A1 Aug. 11, 2022

(30) Foreign Application Priority Data

Jul. 30, 2019 (EP) ..... 19189237

(51) Int. Cl.

| | |
|---|---|
| ***D04H 3/011*** | (2012.01) |
| ***D01D 5/22*** | (2006.01) |
| ***D01D 5/34*** | (2006.01) |
| ***D04H 3/018*** | (2012.01) |
| ***D04H 3/147*** | (2012.01) |

(52) U.S. Cl.
CPC ..... *D04H 3/011* (2013.01); *D01D 5/22* (2013.01); *D01D 5/34* (2013.01); *D04H 3/018* (2013.01); *D04H 3/147* (2013.01); *D10B 2331/04* (2013.01)

(58) Field of Classification Search
CPC ..... D04H 3/011; D04H 3/018; D04H 3/147; D04H 3/007; D04H 3/14; D04H 3/009; D10B 2331/04; D01F 8/14
USPC ..... 442/361, 364, 409
See application file for complete search history.

(56) References Cited

U.S. PATENT DOCUMENTS

| | | | |
|---|---|---|---|
| 3,778,208 | A | 12/1973 | Bisset |
| 2004/0110442 | A1 | 6/2004 | Rhim |
| 2008/0087820 | A1 | 4/2008 | Kurenuma et al. |
| 2017/0145602 | A1 | 5/2017 | Dugan |

FOREIGN PATENT DOCUMENTS

| | | | |
|---|---|---|---|
| JP | 2003013354 | B | 6/2001 |
| WO | 1996002175 | A | 7/1996 |

*Primary Examiner* — Camie S Thompson
(74) *Attorney, Agent, or Firm* — Andrew Wilford

(57) ABSTRACT

A spunbond nonwoven textile is made of endless crimped bicomponent or multicomponent filaments having an eccentric core-sheath configuration. The sheath of the filaments in the filament cross-section has a substantially constant thickness of 0.1 to 5 μm over at least 20% of the filament outer surface.

14 Claims, 2 Drawing Sheets

SPUNBOND NONWOVEN OF CONTINUOUS FILAMENTS AND OF MAKING SAME

CROSS REFERENCE TO RELATED APPLICATIONS

This application is the US-national stage of PCT application PCT/EP2020/069906 filed 14 Jul. 2020 and claiming the priority of European patent application 19189237.1 itself filed 30 Jul. 2019.

FIELD OF THE INVENTION

The invention relates to a spunbond nonwoven textile made of endless filaments, in particular from crimped continuous filaments, wherein the filaments are bicomponent filaments or multicomponent filaments. The invention further relates to an apparatus for making a spunbond nonwoven from endless filaments, in particular from crimped continuous filaments. It is within the scope of the invention that the endless filaments are endless filaments of thermoplastic material. Endless filaments differ due to their quasi-endless length from staple fibers that have much smaller lengths of, for example, 10 mm to 60 mm.

BACKGROUND OF THE INVENTION

For many technical applications, it is desirable to make so-called high-loft nonwovens. These are nonwovens that have a relatively large thickness and at the same time a relatively high softness. However, the production of these nonwovens is not possible without problems, since the nonwovens generally have to have both sufficient strength and abrasion resistance. To this extent, a conflict exists. The setting of a higher strength or abrasion resistance is normally in detriment to thickness and softness of the nonwoven textile. Conversely, maintaining a large thickness and a high softness generally results in less solid and abrasion-resistant nonwovens. Satisfactory solutions have hitherto scarcely been known here. A high thickness of nonwoven textiles is normally made with the aid of crimping or crimping fibers/filaments. In particular, bicomponent filaments having a side-by-side configuration or an eccentric or asymmetrical core-sheath configuration are used for this purpose. Many of the nonwoven textiles known to date consist of crinkled or crimped filaments that however are distinguished by a relatively high defect rate. In particular, undesirable agglomerates are found in the nonwovens, which adversely affect the homogeneity. There is also a need for improvement in this respect.

OBJECT OF THE INVENTION

The object of the invention is to provide a nonwoven textile that has an optimum thickness and an optimum softness and at the same time has a sufficient strength or tensile strength and a sufficient abrasion resistance. In addition, the nonwoven should be as free of defects as possible and, in particular, as free of clumps as possible. The invention further relates to the technical problem of specifying an apparatus for making such a nonwoven textile.

SUMMARY OF THE INVENTION

In order to attain the object, the invention teaches a spunbond nonwoven textile made of endless filaments, in particular crimped or crimped continuous filaments, where the filaments are bicomponent filaments or multicomponent filaments and have an eccentric core-sheath configuration and where the sheath of the filaments in the filament cross-section has a constant thickness or a substantially constant thickness over at least 20%, in particular over at least 25%, preferably over at least 30%, preferably over at least 35% and very preferably over at least 40% of the filament outer surface.

It is within the scope of the invention that the thickness of the sheath of the filaments is the average thickness or average sheath thickness, preferably by the average sheath thickness with respect to a filament. The sheath thickness or the sheath thicknesses are expediently determined by use of a scanning electron microscope. Furthermore, it is within the scope of the invention that the sheath thickness or the average sheath thickness is measured on filaments or filament sections that are not involved in thermal preconsolidation or solidification and are thus not part of bonding points or bonding points. In other words, the sheath thickness is measured on the filaments or the filament sections outside the bonding points or bonding points.

In addition, it is within the scope of the invention that the endless filaments of the nonwoven textile consist of or consist essentially of thermoplastic material. Crimped endless filaments within the scope of the invention are in particular that the crimped filaments each have a crimp of at least 1.5, preferably at least 2, preferably at least 2.5 and very preferably at least 3 loops per centimeter of their length. A recommended embodiment of the invention is characterized in that the endless filaments of the spunbond nonwoven according to the invention have a crimp of 1.8 to 3.2, in particular 2 to 3 loops per centimeter of their length. The number of crimp loops or crimp arcs (loops) per centimeter of length of the filaments are measured in particular according to Japanese Standard JIS L-1015-1981, in that the crimping operations are counted under a bias of 2 mg/den in (1/10 mm), based on the unstretched length of the filaments. A sensitivity of 0.05 mm is used to determine the number of crimp loops. The measurement is expediently carried out using a "Favmat" instrument from TexTechno, Germany. For this purpose, reference is made to the publication "Automatic Crimp Measurement on Staple Fibers," Denkendorf Colloquium, "Textile Measurement C and Test Technology," Sep. 11, 1999, Dr. Ulrich Mortar (in particular p. 4, FIG. 4).

For this purpose, the filaments (or the filament sample) are removed from the deposit or deposit strip as filament clusters before further consolidation, and the filaments are separated and measured.

According to the invention, bicomponent filaments or multicomponent filaments having an eccentric core-sheath configuration are used for the spunbond nonwoven textile. It is within the scope of the invention that the sheath of the filaments completely surrounds the core. Furthermore, it is within the scope of the invention that the material or plastic of the sheath has a lower melting point than the material or plastic of the core of the filaments.

The invention is based on the discovery that, in the spunbond nonwoven according to the invention, a large thickness and a high softness and nevertheless sufficient strength and abrasion resistance can be achieved without problems. In the context of the invention, strength means in particular the strength of the nonwoven textile in the machine direction (MD). In the nonwoven textile according to the invention, a completely satisfactory strength can be realized without any significant loss of thickness. The invention is furthermore based on the discovery that, on the basis of the cross-sectional structure of the filaments according to the invention, optimum crimping can be achieved and, above all, by varying the parameters, it is also possible to set the desired thickness and the desired softness, and at the same time for the sheath material covering the entire filament outer surface to be effectively used for thermal preconsolidation. In this thermal preconsolidation, bonding points between the filaments are made with the aid of the lower-melting sheath material of the filaments and these entail the inventive nonwoven textile with the inventive filament that impart a strength and abrasion resistance to the nonwoven textile, while allowing nevertheless sufficient thickness and softness to be maintained. It is furthermore to be emphasized that the nonwovens according to the invention can be formed surprisingly without defects and, above all, largely free of interfering agglomerates. As a result, a very homogeneous filament layer or nonwoven textile deposit can be achieved.

A nonwoven according to the invention has a thickness of more than 0.5 mm, in particular more than 0.55 mm and preferably a thickness of more than 0.6 mm. It is within the scope of the invention that the nonwoven textiles according to the invention have a strength in the machine direction (MD) of more than 20 N/5 cm, in particular of more than 25 N/5 cm. The above thickness and strength values apply in particular to nonwoven textiles with a weight per unit area of 10 to 50 g/m$^2$, preferably with a weight per unit area of 15 to 40 g/m$^2$ and preferably with a weight per unit area of 18 to 35 g/m$^2$.

It is furthermore within the scope of the invention that the core of the filaments occupies more than 40%, in particular more than 50%, preferably more than 60%, preferably more than 65% and very preferably more than 70% of the area of the filament cross-section of the filaments. According to one embodiment of the invention, the core of the filaments occupies more than 75% of the area of the cross-section of the filaments.

It is recommended that the core of the filaments, seen axially of the filament, is of circularly segmental shape and preferably has, with respect to its outer surface, at least one, in particular a circularly arcuate or substantially circularly arcuate surface portion. It is recommended that the core of the filaments be in the form of filaments viewed in cross section, at least one, in particular a planar or substantially planar surface portion, additionally has at least one, in particular a planar or substantially planar surface portion. According to a particularly preferred embodiment of the invention, the core of the filaments, seen axially of the filament, consists of a circularly arcuate or substantially circularly arcuate surface portion and a planar or substantially planar surface portion that is expediently directly adjacent thereto. A proven embodiment of the invention is characterized in that the circularly arcuate or substantially circularly arcuate surface portion of the core takes up over 40%, in particular over 50%, preferably over 60% and preferably over 65% of the outer surface of the core.

A recommended embodiment is characterized in that the sheath of the filaments C seen axially of the filament C is formed as a circle segment or substantially as a circle segment outside the sheath region with the constant or substantially constant thickness. In this case, this circular segment expediently has at least one, in particular circularly arcuate or substantially circularly arcuate surface portion and preferably at least one, in particular one planar or substantially linear surface portion. Preferably, the circularly segmental sheath section consists of a circularly arcuate or substantially circularly arcuate surface portion and of a planar or substantially flat surface portion that is directly adjacent thereto.

It is within the scope of the invention that the sheath of the filaments C seen axially of the filament C has a constant thickness or a substantially constant thickness over 45%, in particular over 50%, preferably over 55% and preferably over 60% of the filament outer surface. According to a preferred embodiment of the invention, the thickness of the sheath is in the range of its constant or substantially constant thickness less than 10%, in particular less than 8%, preferably less than 7% and preferably less than 3% of the filament diameter or largest filament diameter. Expediently, the thickness of the sheath in the region of its constant or substantially constant thickness is at least 0.5%, in particular at least 1% and preferably at least 1.2% of the filament diameter or of the largest filament diameter. Preferably, the spinneret is selected or set up to make the filaments such that the filaments leaving the spinneret have, in the not yet stretched state, the relative thickness values or percentage thickness values for the sheath specified above and below. However, it is also within the scope of the invention that these relative thickness values also apply to the sheath of the filaments in the finished spunbond nonwoven textile.

According to a recommended embodiment of the invention, the thickness of the sheath in the region of its constant or substantially constant thickness in the finished spunbond nonwoven is 0.05 to 5 μm, in particular 0.1 to 4 μm, preferably 0.1 to 3 μm, preferably 0.1 to 2 μm, very preferably 0.15 to 1.5 μm and particularly preferably 0.1 to 0.9 μm.

It is recommended that the ratio of the mass of the core to the mass of the sheath in the filaments of the spunbond nonwoven according to the invention is 90:10 to 40:60, preferably 90:10 to 60:40 and preferably 85:15 to 70:30. A particularly recommended embodiment of the invention is characterized in that, with respect to the filament cross-section, the spacing a of the centroid of the core from the centroid of the surface of the sheath is from 5% to 38%, in particular from 6% to 36% and preferably from 6% to 34%, preferably from 7% to 33%, of the filament diameter or of the largest filament diameter. Furthermore, a very preferred embodiment of the invention is characterized in that, with respect to the filament cross-section, the spacing a between the centers of the surface to the center of the core is between 5% and 36%, preferably 6% to 36%, and preferably 6% to 34%, preferably 7% to 33% of the filament diameter or of the largest filament diameter. Preferably, at a core:sheath mass ratio of 70:30 to 60:40, the spacing a of the centroids is between 12% and 40% of the filament diameter or the largest filament diameter. It is recommended to have a core:sheath mass ratio of 60:40 to 45:55, the spacing a of the surface centers of core and sheath between 18% and 36%, in particular between 20% and 31% of the filament diameter or of the largest filament diameter.

A particularly recommended embodiment of the invention is characterized in that the core and/or the sheath of the filaments consists of or essentially consists of at least one polyolefin. In particular, in the context of the invention, the core and/or the sheath "substantially" consists of a plastic, in particular in that, in addition to this plastic, additives are also present in the core and/or the sheath. "Consisting substantially" means within the scope of the invention, it is above all that the core and/or the sheath have at least 90% by weight, Preferably at least 95 wt. %, and more preferably at least 97% by weight of the respective plastic. According to a recommended embodiment of the invention, both the core and the sheath of the filaments each consist of at least one polyolefin, in particular of a polyolefin or substantially made of at least one polyolefin, in particular substantially from a polyolefin. A very particularly preferred embodiment of the invention is characterized in that the sheath of the filaments is made or is essentially comprised of polyethylene and that the core of the filaments consists of polypropylene or substantially of polypropylene. It has already been stated above that it is within the scope of the invention that the sheath of the filaments is substantially composed of the lower-melting-point material or plastic in comparison with the core of the filaments. In principle, copolymers of the above-described polyolefins can also be used within the scope of the invention, either alone in the core and/or in the sheath or in a mixture with at least one homo-polyolefin. It is also possible to use mixtures of homo-polyolefins for the core and/or for the sheath. Mixtures with other plastics are also possible.

If polypropylene is used in the context of the invention or polypropylene is used for the core, it is preferably a polypropylene having a melt flow rate of more than 25 g/10 min, in particular more than 40 g/10 min, preferably more than 50 g/10 min, preferably more than 55 g/10 min and very preferably more than 60 g/10 min. The melt flow rate (MFR) in particular according to ASTM D1238-13 (condition B, 2.16 kg, 230 ☜C). If polyethylene is used as component in the context of the invention, in particular as component for the sheath, it is expediently a polyethylene having a melt flow rate of less than 35 g/10 min, in particular below 25 g/10 min, preferably below 20 g/10 min. For polyethylene, the melt flow rate is measured in particular according to ASTM D1238-13 at 190° C./2.16 kg.

An embodiment of the invention is characterized in that the core and/or the sheath of the filaments consists of at least one polyester and/or of at least one copolyester. A recommended embodiment is characterized in that the core of the filaments consists of at least one polyester, in particular of a polyester essentially consists of at least one polyester and/or copolyester that is lower than that of the core component or essentially consists of at least one polyester and/or copolyester that is lower than that of the core component. It is also possible for the core to consist of at least one polyester and/or of at least one copolyester, and for the sheath to consist of or consist essentially of at least one polyolefin. Polyethylene terephthalate (PET) and, in particular, PET copolymer (Co-PET) are particularly suitable as polyesters. However, polybutylene terephthalate (PBT) or polylactide (PLA) or copolymers of these polyesters can also be used as the polyester. It is also within the scope of the invention that mixtures or blends of polymers or said polymers can also be used for the core and/or for the sheath of the filaments. A proven embodiment of the invention is characterized in that the core and/or the sheath of the filaments are made of at least one plastic from the group "polyolefin, polyolefin copolymer, in particular polyethylene, polypropylene, polyethylene copolymer, polypropylene copolymer; polyester, polyester copolymer, in particular polyethylene terephthalate (PET), PET copolymer, polybutylene terephthalate (PBT), PBT copolymer, polylactide (PLA), PLA copolymer." Mixtures or blends of the abovementioned polymers can also be used for core and/or sheath. It is within the scope of the invention that the plastic of the sheath has a lower melting point than the plastic of the core. A recommended embodiment of the invention is characterized in that the core of the filaments is made of at least one plastic from the group of polypropylene, polypropylene copolymer, polyethylene terephthalate (PET), PET copolymer, polybutylene terephthalate (PBT), PBT copolymer, polylactide (PLA), and/or PLA copolymer. According to a preferred embodiment, the sheath of the filaments consists of at least one plastic from the group consisting of "polyethylene, polyethylene copolymer, polypropylene, polypropylene copolymer."

It is within the scope of the invention that the titer of the filaments used for the spunbond nonwoven according to the invention is between 1 and 12 den. According to a recommended embodiment, the titer of the filaments is between 1.0 and 2.5 den, in particular between 1.5 and 2.2 den, and preferably between 1.8 and 2.2 den. This titer or filament diameter has proven particularly successful with regard to the solution of the technical problem according to the invention.

A very proven embodiment is characterized in that the spunbond nonwoven according to the invention is a thermally preconsolidated and/or thermally finished nonwoven textile that has thermal bonding points or thermal bonding points between the filaments. According to a very preferred embodiment, the spunbond nonwoven according to the invention is a nonwoven textile thermally preconsolidated with hot air and/or a thermally finished nonwoven textile. The thermal preconsolidation of the nonwoven textile can in principle also be carried out by compacting rollers. It is also within the scope of the invention that thermal preconsolidation or consolidation of the nonwoven is carried out with the aid of a calender. The invention is based on the discovery that, in the configuration according to the invention of the cross-sections of the filaments, optimum preconsolidation or thermal preconsolidation of the spunbonded nonwovens is possible and nevertheless sufficient crimping and thus the desired thickness of the nonwoven textile can be maintained. To this extent, an optimum compromise between sufficient crimping and thus a sufficient thickness on the one hand and optimum consolidation of the nonwovens is possible. The crimping can be specifically set by varying the cross-sectional parameters of the filaments, and care can also be taken to ensure that the crimping does not assume too great an extent and that, on the contrary, the desired thickness can be made in a precise and functionally reliable manner and, in addition, an effective preconsolidation of the nonwoven can be carried out without a large loss of thickness.

In order to further attain the inventive object, the invention further relates to an apparatus for making a spunbond nonwoven from endless filaments, in particular from crimped continuous filaments, wherein at least one spinneret is provided to make multicomponent filaments or bicomponent filaments having an eccentric core-sheath configuration and whose the sheath seen axially of the filament, has a constant thickness or a constant thickness over at least 20%, in particular over at least 25%, preferably over at least 30%, preferably over at least 35% and very preferably over at least 40% of the filament outer surface, and wherein the filaments are deposited on a support, in particular on a deposition mesh belt. It is within the scope of the invention that the apparatus is a spunbond apparatus. The apparatus has a cooler for cooling the filaments and a stretcher connected thereto for stretching the filaments. Preferably, the apparatus is further equipped with at least one diffuser adjoining the stretcher. A particularly preferred embodiment of the invention is characterized in that the unit comprising the cooler and the stretcher is a closed unit and that, in addition to the supply of cooling air in the cooler, no further supply of air takes place from the outside into this unit.

It is within the scope of the invention that after depositing the endless filaments on the support or on the deposition mesh belt, a thermal preconsolidation of the fiber deposit or the nonwoven web can be carried out. For this purpose, according to the recommended embodiment of the invention, at least one thermal preconsolidater is provided. A recommended embodiment of the invention is characterized in that the at least one thermal preconsolidater is a hot-air preconsolidater. The thermal preconsolidater expediently has at least one hot-air knife and/or at least one hot-air oven. According to another embodiment of the invention, in the context of the invention, thermal preconsolidation or consolidation can also be carried out with pressure rollers or compacting rollers out and/or at least one calender can be used to preconsolidate or consolidate. According to a recommended embodiment of the apparatus according to the invention, a thermal preconsolidation of the deposited nonwoven web is first carried out with the aid of at least one hot-air knife, in particular with the aid of a hot-air knife, and subsequently a further thermal preconsolidation takes place with the aid of at least one hot-air oven, in particular with the aid of a hot-air oven. A preferred embodiment of the invention is characterized in that the spunbond nonwoven textile is preconsolidated only with hot air and/or is merely end-consolidated with hot air. The invention is based on the discovery that, on the basis of the filament cross-section according to the invention, on the one hand the entire filament outer surface is available for thermal preconsolidation and, on the other hand, the thermal preconsolidation or the extent of the thermal preconsolidation can be influenced in a targeted manner by targeted selection of the parameters, in particular the thickness of the sheath, such that, on the one hand, an optimal consolidation of the nonwoven can be achieved and, on the other hand, the crimping of the filaments is not impaired too much to maintain a desired thickness of the nonwoven textile. Within the scope of the invention, particularly on account of the filament cross-section according to the invention, a very simple and targeted adjustment of the nonwoven properties, in particular with regard to thickness, softness and strength, is possible. Above all, the invention makes it possible to adjust the crimping without difficulty and thus to control it.

The nonwoven textiles according to the invention are distinguished on the one hand by an optimum thickness and softness and on the other hand by a satisfactory strength or abrasion resistance. Because of the configuration of the filaments according to the invention, the crimping of the filaments can be kept within the desired limits without problems, so that a controllable crimping or a controllable crimp is the result of the teaching according to the invention. In the case of optimum strength and abrasion resistance that is simple to make, it is also possible to achieve a substantially defect-free nonwoven that is mainly free of interfering agglomerates. In summary, it can be stated that, within the scope of the invention, an optimum compromise between strength properties and thickness or softening properties of the nonwoven textile can be achieved and this compromise can be achieved in a simple manner in the case of a surprisingly homogeneous filament deposition.

BRIEF DESCRIPTION OF THE DRAWING

The invention is explained in more detail below on the basis of a drawing showing only one embodiment. The following are shown in schematic representation.

SPECIFIC DESCRIPTION OF THE INVENTION

Figure 1A:
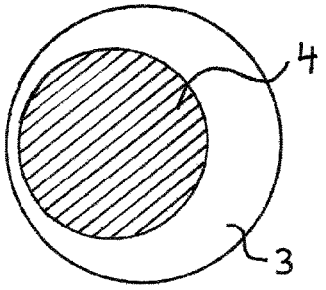
Fig. 1A Prior Art
FIG. 1A is a cross-sectional view of an endless filament with conventional eccentric core-sheath configuration.
Figure 1B:
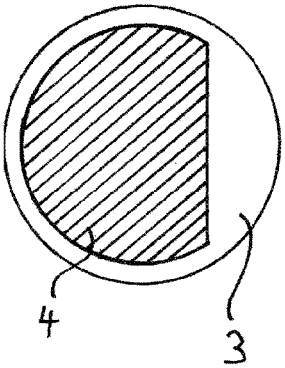
FIG. 1B b with an eccentric core-sheath configuration according to the invention.
Figure 2:
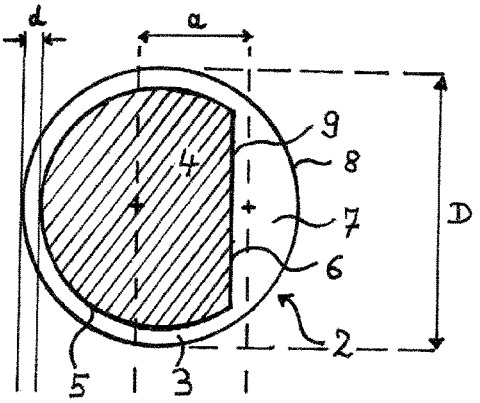
FIG. 2 shows a section through an endless filament according to the invention in detail.

FIGS. 1A and B show, in comparison sections through an endless filament 2 with a conventional eccentric core-sheath configuration (FIG. 1A) and by an endless filament 2 with an eccentric core-sheath configuration according to the invention (FIG. 1B). In both cases, it is an object of the present invention to provide a method and an apparatus for carrying out the method of the present invention Bicomponent filaments have a first component made of thermoplastic material in the sheath 3 and with a second component made of thermoplastic material in the core 4. Expediently, the component in the sheath 3 has a lower melting point than the component in the core 4. FIG. 1B and FIG. 2 show that, in the case of the endless filaments 2 for a spunbond nonwoven textile 1 according to the invention, the sheath 3 of the filaments 2 in the filament cross-section preferably and here has a constant thickness d over more than 50% of the filament outer surface. Preferably, and here, the core 4 of the filaments 2 occupies more than 65% of the area of the filament cross-section of the filaments 2.

It is recommended that the core 4 of the filaments 2 according to the invention, as seen in the filament cross-section, is of circularly segmental shape. Expediently and here, the core 4 has, with respect to its outer surface, a circularly arcuate outer-surface portion 5 and a planar outer-surface portion 6. Actually and here, the circularly arcuate outer-surface portion of the core 4 occupies over 65% of the outer surface of the core 4. Expediently and here, the sheath 3 of the filaments 2 C seen axially of the filament C is shaped to be circularly segmental outside the sheath region with the constant thickness d. This circular segment 7 of the sheath 3 has a circularly arcuate surface portion 8 as well as a planar surface portion 9 here with respect to its outer surface.

The thickness d or the average thickness d of the sheath 3 in the region of its constant thickness is preferably 1% to 8%, in particular 2% to 10% of the filament diameter D. Here, the thickness d of the sheath 3 may be 0.2 to 3 μm in the region of its constant thickness.

FIG. 2 shows the spacing a of the center of gravity of the core 4 from the center of gravity of the sheath 3 of an endless filament according to the invention 2. This spacing a between the centers of surface centers of the core 4 and the sheath 3 is regularly greater in the case of a given mass or surface ratio of the core and sheath material in the case of the endless filaments 2 according to the invention than in conventional endless filaments 2 having an eccentric core-sheath configuration. The spacing a of the center of gravity of the core 4 from the center of gravity of the sheath 3 in the filaments 2 according to the invention is preferably 5 to 40% of the filament diameter D or the largest filament diameter D.

Figure 3:
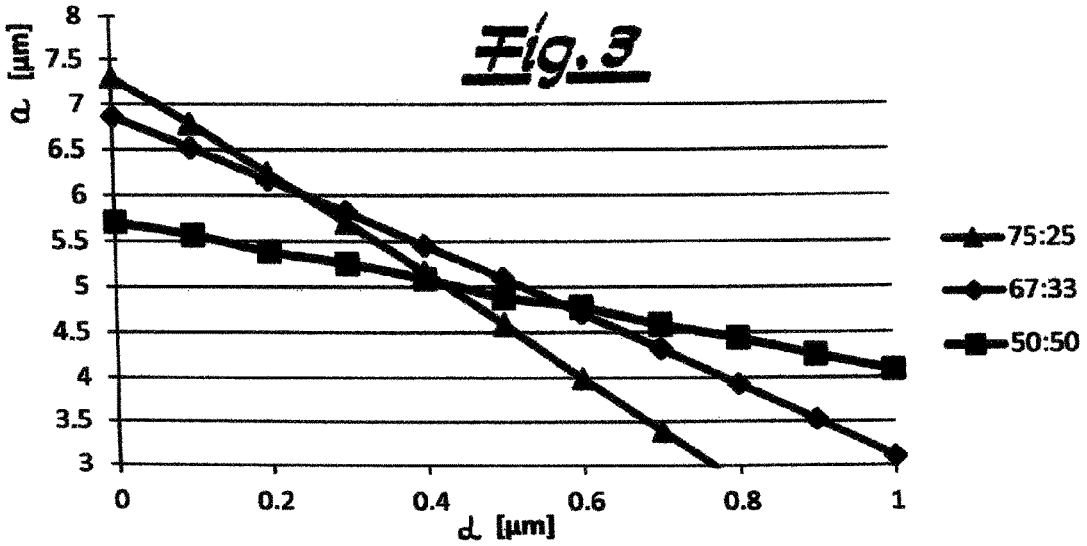
FIG. 3 schematically shows the dependence of the spacing a of the centroids of centers of the core and sheath of a continuous filament according to the invention depend on the thickness d of the sheath of the endless filaments in the region of the constant thickness d of the sheath.

FIG. 3 shows schematically for preferred embodiments of the invention the dependence of the spacing a between the centroids of the core 4 and the sheath 3 from the constant thickness d of the sheath 3 of the endless filaments 2 according to the invention. The dependence is shown here for a surface proportion of the core 4 of 75%, of 67% and of 50%. The spacing a and the constant sheath thickness d of the sheath 3 are each indicated in micrometers. The underlying endless filaments 2 according to the invention here have a filament diameter D of 18 μm.

In the table below, the spacings a between the centers of centers of the core 4 and the sheath 3 for endless filaments 2 with a filament diameter D of 18 μm are specified, specifically for different surface conditions: core:sheath (75:25, 67:33 and 50:50). On the left in the table, these spacings are listed for a constant sheath thickness d of 1 μm for the continuous filaments according to the invention having an eccentric core-sheath configuration (eC/S filaments according to the invention). To the right in the table are the spacings for a sheath thickness d' of 1 ☛m at the location of the smallest spacing between the core 4 and the outer surface for the endless filaments 2 with conventional eccentric core-sheath configuration (prior-art eC/S filaments). The spacing a of the centroid centers is here in each case set absolutely in μm and relative to the filament diameter D in %.

| | Inventive eC/S filaments | | Prior-art eC/S filaments | |
|---|---|---|---|---|
| Surface ratio core/sheath | Absolute μm | Relative to D (%) | Absolute μm | Relative to D (%) |
| 75:25 | 1.5 | 8 | 0.4 | 2 |
| 67:33 | 3.11 | 17 | 1.1 | 6 |
| 50:50 | 4.1 | 23 | 2.5 | 14 |

It can be seen from the table that the spacing a of the centroids with the same filament diameter D and the same area ratio core:sheath in the continuous filaments 2 according to the invention with an eccentric core-sheath configuration is in each case greater or significantly greater than in the case of the conventional continuous filaments 2 with an eccentric core-sheath configuration. Maintaining the spacing a between the centers of gravity of the core 4 and the sheath 3 is an essential feature of the invention that is of particular importance. The spacing between the surfaces of centers is representative of the lever arm with which the crimping forces from the two materials act and thus a substantial factor for the extent of crimping.

Preferably, and here, the core 4 of the filaments 2 according to the invention consists of polypropylene and the sheath 3 of the filaments 2 consists of polyethylene. This is a very particularly preferred embodiment that has proven very successful within the scope of the invention. It is fundamentally within the scope of the invention that the melting point of the thermoplastic plastic of the sheath 3 is less than the melting point of the thermoplastic material of the core 4 of the continuous filaments 2 according to the invention.

According to a preferred embodiment of the invention, the endless filaments 2 of a spunbond nonwoven textile 1 according to the invention have a titer of 1.5 to 2.5, preferably of 1.5 to 2.2, and preferably of 1.8 to 2.2. This titer has proven quite particularly successful with regard to the solution of the technical problem. It is furthermore within the scope of the invention that the spunbond nonwoven textile 1 according to the invention is a thermally preconsolidated spunbond nonwoven textile, to be precise with thermal bonding points or bonding points between the endless filaments 2. In a very particularly preferred embodiment, the spunbond nonwoven textile 1 according to the invention is a spunbond nonwoven textile 1 that is thermally preconsolidated with hot air. Such a spunbond nonwoven textile 1 has proven very successful with regard to the solution of the technical problem.

Figure 4:
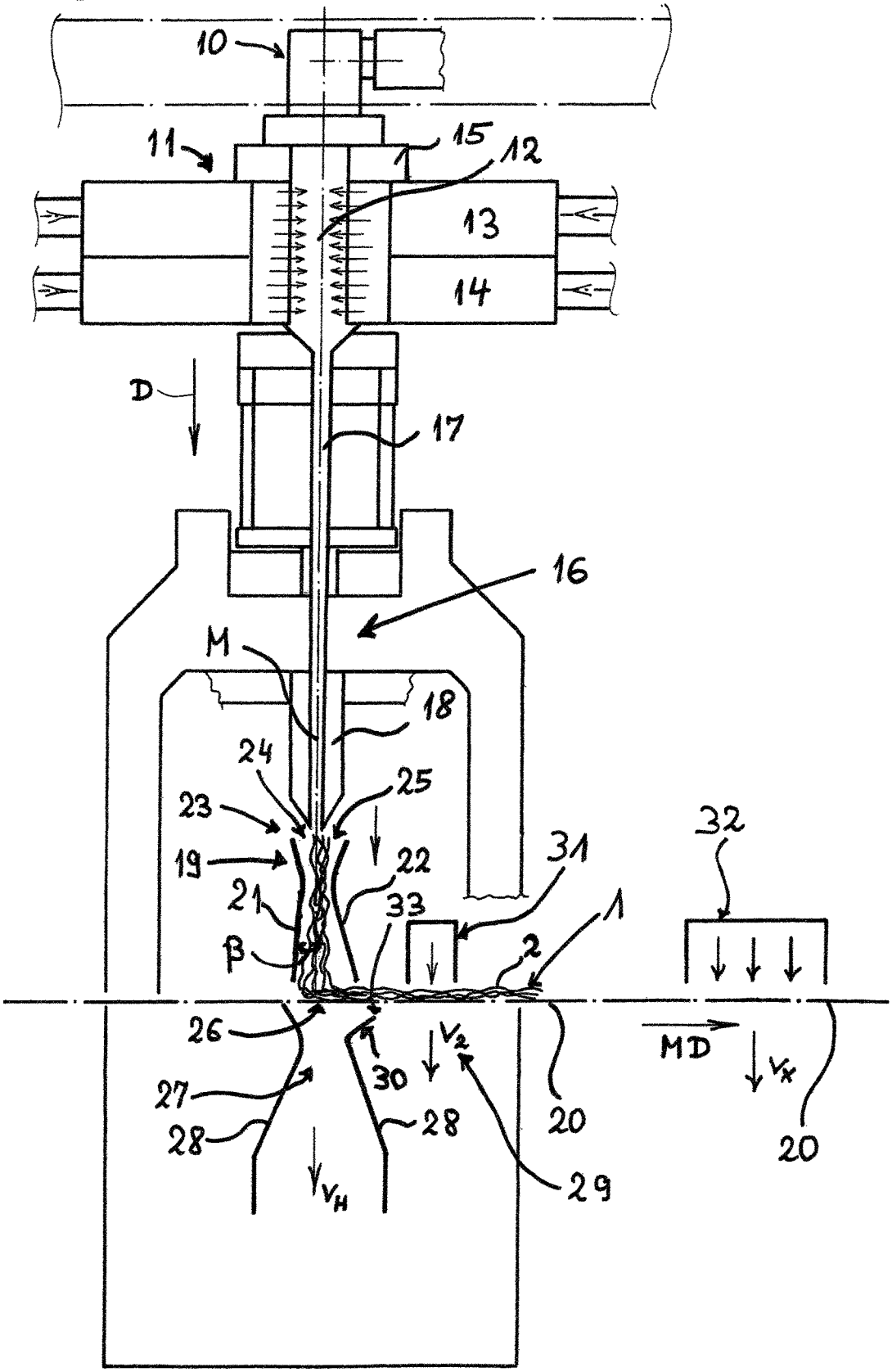
FIG. 4 is a vertical section through an inventive apparatus for making a spunbond nonwoven according to the invention.

FIG. 4 shows an apparatus according to the invention for making a spunbond nonwoven textile 1 according to the invention and consisting in particular of crimped continuous filaments 2. The spunbond apparatus comprises a spinneret 10 or a spin head for spinning the endless filaments 2. The spinneret 10 or the apparatus is designed in such a way that the endless filaments 2 are multicomponent filaments or bicomponent filaments having an eccentric core-sheath configuration, preferably as continuous filaments 2, in which the sheath 3 has a constant thickness d, as seen in the filament cross-section, over at least 50% of the filament outer surface.

Preferably and here, the spun endless filaments 2 are introduced into a cooler 11 with a cooling chamber 12.

Expediently and here, air supplies 13, 14 one above the other are on two opposite sides of the cooling chamber 12. Air of different temperatures is expediently introduced into the cooling chamber 12 from the air supplies 13, 14 one above the other.

According to a preferred embodiment and here according to FIG. 4, a monomer extractor 15 is between the spinneret 10 and the cooler 11. With this monomer extractor 15, unwanted gases produced during the spinning process can be removed from the apparatus. These gases can be, for example, monomers, oligomers or decomposition products and similar substances.

In the filament travel direction D, a stretcher 16 for stretching the endless filaments 2 is connected downstream of the cooler 11. Recommended and here, the stretcher 16 has an intermediate passage 17 that connects the cooler 11 to a stretching shaft 18 of the stretcher 16. According to a particularly preferred embodiment and here, the assembly composed of the cooler 11 and the stretcher 16 or the unit comprising the cooler 11, the intermediate passage 17 and the stretching shaft 18 is closed and, in addition to the supply of cooling air in the cooler 11, no further supply of air takes place from the outside into this assembly.

Here, a diffuser 19, through which the endless filaments 2 are guided, extends down from the stretcher 16 in the filament travel direction. After passing through the diffuser 19, the endless filaments 2 are preferably deposited, here on a support formed by a deposition mesh belt 20. The deposition mesh belt 20 is preferably an endlessly circulating belt 20. It is expediently designed to be foraminous, so that suction from below through the storage screen belt 20 is possible.

According to the recommended embodiment and here, the diffuser 19 or the diffuser 19 directly above the deposition screen band 20 has two opposite diffuser walls, two lower diverging diffuser wall sections 21, 22 being provided that are preferably formed asymmetrically with respect to the center plane M of the diffuser 19. Expediently and here, the diffuser wall section 21 on the inlet side forms a smaller angle ß with the center plane M of the diffuser 19 than the outlet-side diffuser wall section 22. This, before the preferred embodiment, is of particular importance within the scope of the invention and has proven particularly successful with regard to the solution of the technical problem. The terms on the inlet side and on the outlet side otherwise relate to the running direction of the deposition mesh belt 20 or to the conveying direction of the nonwoven web.

According to a recommended embodiment of the invention, two opposite secondary air inlet gaps 24, 25 are provided at the inflow end 23 of the diffuser 19, each of which is on one of the two opposite diffuser walls. Preferably, a smaller secondary air volume flow can be introduced through the secondary air inlet gap 24 on the inlet side with respect to the conveying direction of the deposition mesh belt 20 than through the secondary air inlet gap 25 on the outlet side. This embodiment also has particular importance within the scope of the invention.

It is recommended here that at least one aspirator is provided to draw air or process air through the mesh belt 20 in the storage area 26 of the filaments 2 in a main suction area 27. The main suction region 27 is expediently bounded below the deposition mesh belt 20 in an inlet region of the deposition mesh belt 20 and in an outlet region of the deposition mesh belt 20 in each case by a suction separating wall 28. Preferably and here, a second suction region 29 is connected downstream of the main suction region 27 in the conveying direction MD of the deposition mesh belt 20, in which second suction region air or process air can be sucked through the deposition mesh belt 20. It is recommended that the suction speed $V_2$ of the process air through the deposition mesh belt 20 in the second suction region 29 is less than the suction speed $V_H$ in the main suction region 27.

A particularly preferred embodiment is characterized in that the end of a suction partition 28 facing the storage screen belt 20 has a vertical spacing A from the storage screen belt 20 between 10 and 250 mm, in particular between 25 and 200 mm, preferably between 28 and 150 mm and preferably between 29 and 140 mm and very preferably between 30 and 120 mm. According to a very recommended embodiment, in the region of this suction separating wall 28 facing the deposition mesh belt 20, a separating wall section is connected that is a bent section 30 and comprises the above-mentioned end of the suction separating wall 28 facing the deposition mesh belt 20. It is within the scope of the invention that the end of this bent section 30 adjacent the storage screen belt 20 forms an imaginary extension of the remaining associated suction partition 28 with a horizontal spacing C that corresponds to at least 80% of the vertical spacing A. The spacings A and C are not shown in the figures. According to a recommended embodiment shown in FIG. 4, the suction partition 28 has on the screen belt side a partition section that is angled away from the rest of the suction partition 28 and is the bent section 30. Expediently and here, this bent section 30 is provided on the outlet-side suction separating wall 28 of the suction extraction region 27. According to a proven embodiment of the invention, the bent section 30 is more angled with respect to a vertical perpendicular to the storage screen belt surface than a partition section of the other, opposite suction partition 28 facing the storage screen belt 20. Expediently, the bent section 30 has a greater length than the corresponding projection of an angled or bent partition section of the further opposite suction partition 28 facing the storage screen belt 20 in its projection onto the storage screen belt surface. It is recommended that the bent section 30 has, with respect to its end on the screen belt side, a greater spacing from the deposition mesh belt 20 than that end of the separating wall section of the further opposite suction separating wall 28 that faces the deposition mesh belt 20. The embodiment with the bent section 30 ensures a very uniform and continuous transition of the suction speeds from the main suction region 27 to the region following in the conveying direction MD of the deposition mesh belt 20 and in particular to the second suction region 29. As a result of the arrangement of the bent section 30, a very continuous drop in the suction speed can be achieved. This makes it possible to largely avoid defects in the nonwoven web or in the spunbond nonwoven textile 1 according to the invention, which can occur due to abrupt changes in the suction speed, for example by back-flow effects (so-called blow-back effects) in the transition region between the main suction region TI and the second suction region 29. Here with the bent section 30, this is therefore a very preferred embodiment that contributes to attaining the object of the invention.

Expediently and here, at least one thermal preconsolidater for thermally preconsolidating the nonwoven web is provided downstream of the depositing region 26 in the conveying direction of the nonwoven web. Preferably, the thermal preconsolidater is at or above the second suction region 29. According to a particularly preferred embodiment, the thermal preconsolidater operates with hot air and, with particular preference, this thermal preconsolidater downstream of the main suction region 27 is a hot air knife 31. With the thermal preconsolidater, bonding points between the filaments 2 of the nonwoven web can be realized in a simple manner. In this case, the sheath 3 of the endless filaments 2 according to the invention covering the entire outer surface can be used very effectively to form thermal bonding points.

According to one embodiment of the invention, at least two thermal preconsolidaters are provided for preconsolidating the nonwoven web. Expediently, the first thermal preconsolidater in the conveying direction of the nonwoven web is the hot-air knife 31 and, preferably, a second thermal preconsolidater in the form of a hot-air oven 32 is connected downstream of this hot-air knife 31 in the conveying direction of the deposition mesh belt 20. It is within the scope of the invention that, even in the region of the hot air oven 32, air is sucked through the storage screen belt 20. In addition, it is within the scope of the invention that the suction speed of the air sucked down through the storage screen belt 20 decreases from the main suction region 27 to further suction regions in the conveying direction of the deposition mesh belt 20.

FIG. 4 shows a spunbond apparatus according to the invention with a spinneret 10 and thus with a spinning beam. It is also within the scope of the invention that a spunbond apparatus according to the invention can be used in the context of a 2-beam system or multibeam system. According to one embodiment, several spunbond apparatuses according to the invention can be used one after the other.

The invention claimed is:

1. A spunbond nonwoven textile made of endless crimped bicomponent or multicomponent filaments having an eccentric core-sheath configuration, wherein the sheath of the filaments in the filament cross-section has a substantially constant thickness of 0.1 to 5 μm over at least 20% of the filament outer surface.

2. The spunbond nonwoven according to claim 1, wherein the filaments have cores that each occupy more than 50% of the cross-section of the respective filaments.

3. The spunbond nonwoven according to claim 1, wherein the filaments have cores of of circularly segmental shape as viewed in cross-section and have outer surfaces each formed by a substantially circularly arcuate outer-surface portion and a substantially planar outer-surface portion.

4. The spunbond nonwoven according to claim 3, wherein the circularly arcuate surface portion of each of the cores covers over 50% of the outer surface of the core.

5. The spunbond nonwoven according to claim 1, wherein the filaments have sheaths as seen in the filament cross-section each formed except at the sheath region with the constant thickness substantially as only one circle segment and only one planar or substantially planar surface portion.

6. The spunbond nonwoven according to claim 1, wherein the filaments have sheaths of a constant thickness or a substantially constant thickness as seen in the filament cross section of over 45% of a filament outer surface.

7. The spunbond nonwoven according to claim 1, wherein the filaments each have a ratio of a mass of the core to a mass of the sheath of 90:10 to 50:50.

8. The spunbond nonwoven textile according to claim 1, wherein cores and sheaths of the filaments consist of at least one polyolefin.

9. The spunbond nonwoven textile according to claim 1, wherein the filaments each have a core that consists of or substantially consists of a polyester, and a sheath that consists of or essentially consists of a copolyester.

10. The spunbond nonwoven according to claim 1, wherein a titer of the filaments is 1.5 to 2.5.

11. The spunbond nonwoven textile according to claim 1, wherein the nonwoven textile is a thermally preconsolidated or thermally finished nonwoven textile that has bonding points between the filaments.

12. A spunbond nonwoven made of endless crimped bicomponent or multicomponent filaments having an eccentric core-sheath configuration, wherein the filaments each have over at least 20% of the filament outer surface sheaths each of a substantially constant thickness of less than 10% of a filament diameter or of a largest filament diameter.

13. A spunbond nonwoven made of endless crimped bicomponent or multicomponent filaments having an eccentric core-sheath configuration, wherein a spacing of a centroid of the core from a centroid of the sheath is 5% to 45% of a filament diameter or of a largest filament diameter and the sheaths of the filaments in the filament cross-section each have a substantially constant thickness over at least 20% of the filament outer surface.

14. The spunbond nonwoven according to claim 13, wherein a spacing of the centroids at a core:sheath mass ratio from 85:15 to 70:30 is between 5% and 45% of the filament diameter or the largest filament diameter or a core:sheath mass ratio of 70:30 to 60:40 is between 12% and 40% of the filament diameter or of the largest filament diameter or at a core:sheath mass ratio of 60:40 to 45:55 is between 18% and 36% of the filament diameter or of the largest filament diameter.

* * * * *